United States Patent [19]

Grant

[11] Patent Number: 4,977,864

[45] Date of Patent: Dec. 18, 1990

[54] DIESEL ENGINE

[76] Inventor: Lloyd L. Grant, 1323 Karshner Rd., Puyallup, Wash. 98371

[21] Appl. No.: 609,480

[22] Filed: May 11, 1984

Related U.S. Application Data

[63] Continuation of Ser. No. 45,592, Jun. 4, 1979, abandoned.

[51] Int. Cl.[5] ..... F02B 59/00

[52] U.S. Cl. ..... 123/50 B; 123/56 BC

[58] Field of Search ..... 123/56, 50 R

[56] References Cited

U.S. PATENT DOCUMENTS

| | | | |
|---|---|---|---|
| 963,880 | 7/1910 | Eason | 123/50 R |
| 1,316,192 | 9/1919 | Sawyer | 123/50 R |
| 1,355,428 | 10/1920 | Robinson | 123/50 R |
| 1,730,073 | 10/1929 | Heckman | 123/50 R |
| 1,844,478 | 4/1928 | Omo | 123/50 R |
| 2,063,970 | 12/1936 | Young | 123/50 R |
| 2,067,496 | 1/1937 | McCarthy | 123/50 R |
| 2,126,270 | 8/1938 | Moore | 123/50 R |
| 2,127,729 | 8/1938 | Grant | 123/50 R |
| 2,127,758 | 8/1938 | Schmitz | 123/50 R |
| 2,132,802 | 10/1938 | Pierce | 123/56 |
| 2,137,730 | 11/1938 | Smith | 123/50 R |
| 2,184,820 | 12/1939 | Tucker | 123/50 R |
| 2,213,817 | 9/1940 | Kinslow | 123/50 R |
| 2,231,626 | 2/1941 | Hug | 123/50 R |
| 2,251,662 | 8/1941 | Crumpler | 123/50 R |
| 2,270,597 | 1/1942 | Merrell | 123/50 R |
| 2,401,262 | 5/1946 | McCallion | 123/50 R |
| 2,405,016 | 7/1946 | Cook | 123/50 R |
| 2,458,672 | 1/1949 | Zoch, Jr. | 123/50 R |
| 2,482,967 | 9/1949 | Cook | 123/50 R |
| 3,191,584 | 6/1965 | Brahler | 123/50 R |
| 3,340,858 | 9/1967 | Gerin | 123/50 R |
| 3,630,178 | 12/1971 | Erickson | 123/50 R |
| 4,074,671 | 2/1978 | Pennila | 123/50 R |

FOREIGN PATENT DOCUMENTS

| | | | |
|---|---|---|---|
| 417588 | 9/1923 | Fed. Rep. of Germany | 123/50 R |
| 81701 | 12/1953 | Norway | 123/50 R |
| 280008 | 11/1927 | United Kingdom | 123/50 R |

*Primary Examiner*—Craig R. Feinberg

[57] ABSTRACT

An engine is disclosed that is applicable for automotive and truck use but is also adaptive for other power producing uses. Two reciprocating cylinders are housed within an outer cylinder. A piston is housed within each of the two reciprocating cylinders. The reciprocating cylinders are so designed that after combustion in one reciprocating cylinder, the movement caused by the combustion will aid in setting up the circumstances combustion in the opposing compression chamber formed by the opposing reciprocating cylinder and opposing piston. Due to this design, the horizontal reciprocating movement is continuous and all of the horizontal movement caused by the combustion in both opposing reciprocating cylinders and both opposing pistons is useful. The horizontal movement of the reciprocating cylinders and pistons is translated into rotational energy in the crankshaft by three scotch yokes, each scotch yoke housing a scotch block, each scotch block in turn surrounding one crankthrow.

3 Claims, 6 Drawing Sheets

DIESEL ENGINE

This application is a continuation of U.S. patent application Ser. No. 045,592, filed Jun. 4, 1979 now abandoned.

BACKGROUND OF THE INVENTION

One of the primary criterion for evaluating an engine's performance is its fuel economy. The present invention rates well in this category for it utilizes all the horizontal movement generated after combustion. Thus, there is no energy expended for the sole purpose of producing another combustion chamber in a companion cylinder. Traditional engines must use some of the energy generated after combustion in setting up compression in an opposing cylinder without translating any of the energy in setting up the combustion chamber into rotational energy in the crankshaft. In the present invention, all movement before and after combustion translates and aids in generating rotational energy in the crankshaft.

The simplicity of design of the disclosed engine aids both in the lower manufacturing cost and also in fuel efficiency. The engine has few moving parts and eliminates the necessity of the following: camshaft, cams, camshaft bearings, gears, timing chains, sprockets, valves, valve seats, valve lifters, rocker arms, springs, connecting rods or piston pins. Due to the simplicity of the engine, the engine can be built to weigh a fraction of conventional engines.

Conventional engines have also necessarily been designed to absorb the energy of the piston and the resultant energy from the explosion in the opposite direction of the piston. This necessarily adds to the weight of the engine. In the engine disclosed, the energy after explosion is utilized in the movement of the reciprocating cylinder and in the movement of the piston. This serves two purposes: the movement caused by the combustion is translated into useful power and also it acts as an inherent cushion. Due to the cushioning effect after combustion strong damaging forces to the engine itself are eliminated. By reducing the potentially damaging forces to the engine, the engine may naturally be lighter weight which aids in the fuel economy.

A patent was issued to Lloyd L. Grant on Aug. 23, 1938, the patent related to internal combustion engines. The engine used a crankhead which was journaled on the crank in order to obtain rotational energy on the crankshaft. However, as in other conventional engines, the piston was set within a fixed housing. Thus, the engine experienced the same problems as outlined above. The inventor has solved these problems and obtained the above advantages, by designing a reciprocating cylinder in addition to the opposing piston thereby obtaining useful energy from all components of the force exerted after combustion.

DETAILED DESCRIPTION OF THE DRAWINGS

Figure 1:
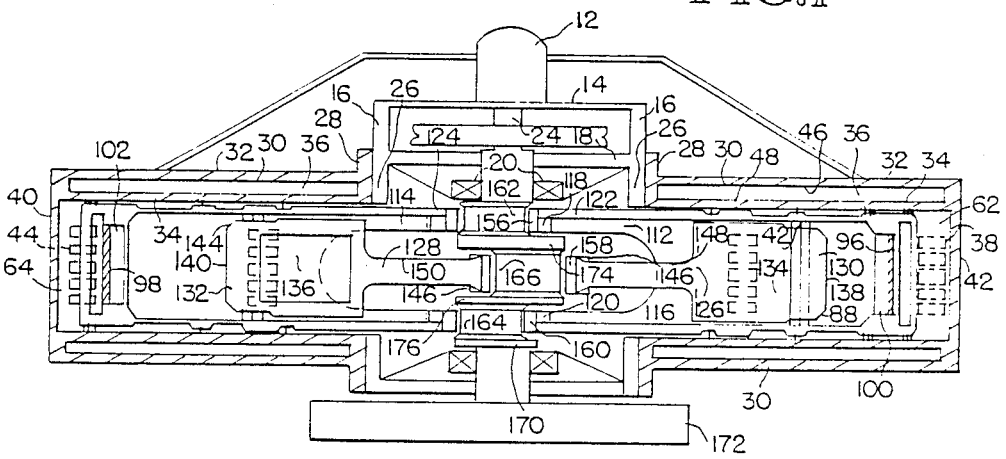
FIG. 1 is an overhead cutaway view of the engine. The outer cylinder is cut away totally and the reciprocating cylinder is cut away partially. The fuel injection system, crankshaft and flywheel are also illustrated.

In FIG. 1 a cutaway side view of the diesel engine 10 is illustrated. The engine 10 in the preferred embodiment is designed to be used in association with an automobile. However, the engine 10 may be adapted to power a number of uses.

In the detailed description of the drawings the various parts and their configurations will first be discussed. Subsequent to description of the individual parts, the interaction of the parts and their steps in the operation of the engine 10 will be detailed.

In FIG. 1 the fuel injection pump 12 is secured to the fuel pump support plate 14. The fuel injection pump is driven off the front end of the crankshaft. The fuel pump support plate 14 is in turn secured to the fuel pump support walls 16 which are in turn secured to the crankcase 18. Thus, the combination of fuel pump support plate 14 and walls 16 secure the fuel injection pump 12 to the crankcase 18.

Within the crankcase 18 is the crankcase bearing retainer 20. The crankcase bearing retainer 20 houses the crankshaft main bearing 22. The crankshaft main bearing 22 in turn houses the crankshaft 24. Besides housing the crankshaft main bearing 22 the crankcase bearing retainer 20 surrounds crankshaft 24.

Affixed to the crankcase wall 26 is the outer cylinder flange 28 of the outer cylinder 30. The outer cylinder 30 is constructed of a surrounding wall 32 and an inner wall 34. The surrounding wall 32 and inner wall 34 form water jacket compartments 36. As set forth in the preferred embodiment, the engine 10 is water cooled. However, the engine can alternatively be air cooled.

Figure 2:
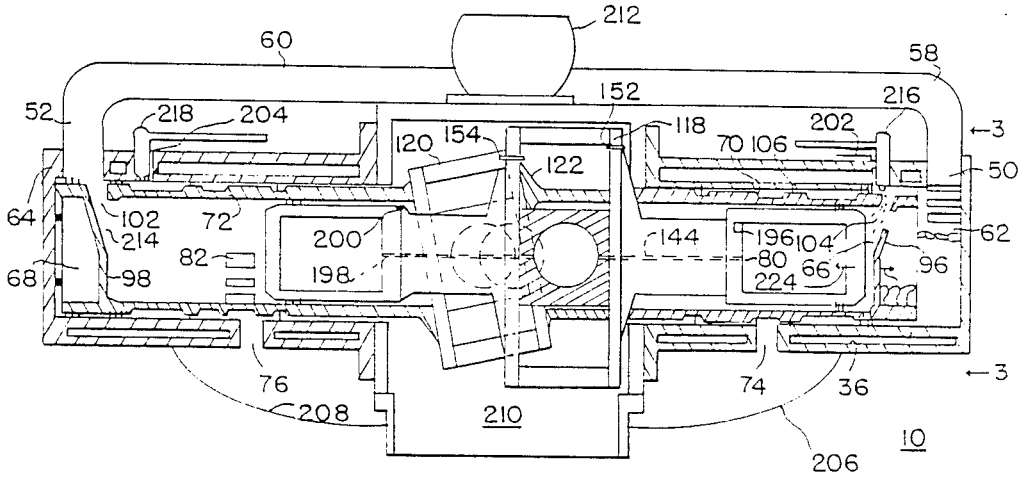
FIG. 2 is a side cutaway view of the engine. The outer cylinder is cut away totally and the reciprocating cylinder is cut away partially to illustrate the scotch blocks and inner piston. The air blowing system is additionally illustrated.

Affixed to the surrounding wall 32 and inner wall 34 at either end of the outer cylinder 30 are the air chamber end walls 38 and 40. As set forth in FIG. 2, the inner wall 34 of the outer cylinder 30 has a series of air inlets 42 and 44 in close proximity to the air chamber end walls 38 and 40 respectively. Water jacket compartment walls 46 and 48 which are secured between the surrounding wall 32 and inner wall 34 form air jackets 50 and 52. Air jacket 50 is formed adjacent to air chamber end wall 38 while air jacket 52 is formed adjacent to air chamber end wall 40. In FIG. 2 a portion of the inner wall 34 is not cut away thus illustrating the air inlets 42 position in relation to the inner wall 34 and the surrounding air jackets 50 and 52.

As set forth in FIG. 2, the series of air inlets are set in a position directly in line with the orifices 54 and 56 of the air blower lines 58 and 60. Thus, when air is forced through the air blower lines 58 and 60, the air passes into air jackets 50 and 52 and subsequently through their inlets 42 and 44, and subsequently into air chambers 62 and 64 or combustion chambers 66 and 68 depending on the position of the reciprocating cylinders 70 and 72.

Figure 4:
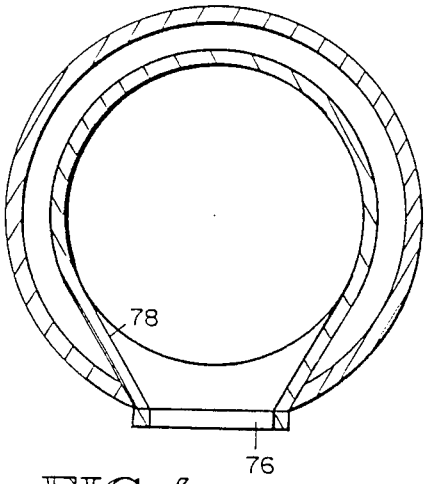
FIG. 4 is a cutaway end view of the outside cylinder taken along line 4—4 showing the configuration of the exhaust port of the outside cylinder.
Figure 3:
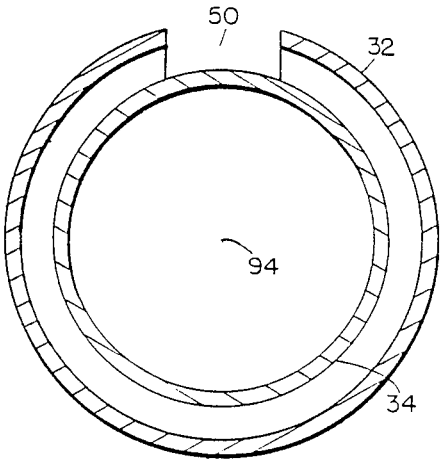
FIG. 3 is a cutaway end view of the outside cylinder taken along line 3—3 showing the position of the air inlets.

Through both the inner wall 34 and surrounding wall 32 of the outer cylinder 30 are exhaust ports 74 and 76. The exhaust ports 74 and 76 are positioned on the outer cylinder 30 to correspond properly with the strokes of the reciprocating cylinders 70 and 72. The configuration of the exhaust ports 74 and 76 are illustrated in FIG. 4. Since their configuration are identical only one port is illustrated. The exhaust port 74 has a surrounding wall 78 which defines the dimension of the exhaust port 74. As set forth in FIG. 4, the exhaust port surrounding wall 78 is slanted in a funnel-like configuration. The funnel-like configuration allows the entrapment of exhaust gases from a number of exhaust ports 80 and 82 positioned on the reciprocating cylinders 70 and 72. The exhaust ports 80 and 82 are positioned about a portion of the circumference of their respective reciprocating cylinders. The exhaust ports 80 and 82 cover a partial diameter of the reciprocating cylinder equivalent to the inner orifice 84 of both the exhaust ports 80 and 82. Thus, when exhaust is forced out of the exhaust ports 80 and 82 of the reciprocating cylinders 70 and 72 the exhaust is totally collected in the inner orifice 84 of the exhaust port 74 and forced out the exhaust port outer orifice 86. The water jacket compartment 36 is interrupted by the exhaust ports 74 and 76 but nevertheless partially abuts the surrounding wall of the exhaust port 78.

Housed within the cylinder 30 are the reciprocating cylinders 70 and 72. The reciprocating cylinder 70 is shown in detail in FIG. 5. The configuration of the reciprocating cylinders 70 and 72 are identical and, therefore, only reciprocating cylinder 70 is discussed in detail.

At the end of the reciprocating cylinder 70 is the outer reciprocating cylinder projection 88 of the reciprocating cylinder 70. The outer reciprocating cylindrical projection 88 is surrounded by outer reciprocating cylindrical rings 90.

The reciprocating cylinder end is open for a slight distance until meeting the compression wall. Thus, the reciprocating cylinder 70 is open and hollow until the inner diameter of the reciprocating cylinder 94 is closed by the inner compression walls 96 and 98. The configuration of the compression walls 96 and 98 are fully shown in FIG. 1, and at right angles with the inner walls 34 and covers the entire inner diameter of the reciprocating cylinder 94.

Figure 5:
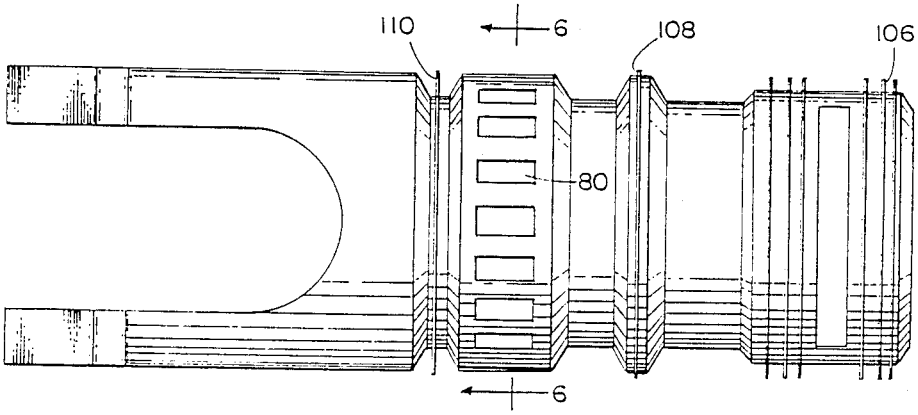
FIG. 5 is a side view of a reciprocating cylinder.
Figure 6:
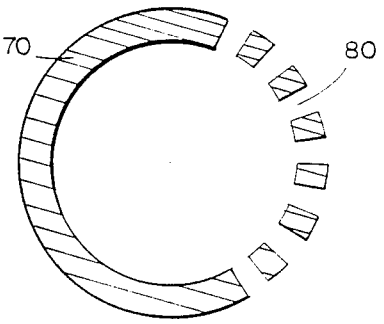
FIG. 6 is a cutaway side view of the reciprocating cylinder.

Also illustrated in FIG. 1 and FIG. 5 are reciprocating cylinder intake ports 100 and 102 which are positioned in the close proximity of the reciprocating cylinder end 92. At the outer edge of the fuel injection intake port 100 the compression wall 96 is secured. Circumferencing the reciprocating cylinder 70 immediately inward of the reciprocating cylinder intake port 100 is ring set 106.

As illustrated in FIG. 5 additional oil control ring set 108 circumferences the reciprocating cylinder 70 between the ring set 106 and the exhaust port 80 of the reciprocating cylinder 70. Inside the exhaust port 80 circumferencing the reciprocating cylinder 70 is the inner oil control ring set 110. The inner oil control ring set 110 serves two purposes: first it keeps oil from filtering down into the crankcase 18; and second, it keeps oil from filtering into the intake ports 100.

The reciprocating cylinders 70 and 72 have forward flanges 112 and 114 which slant from approximately the outer diameter of the reciprocating cylinders 70 and 72 to approximately ⅛ of the diameter of the reciprocating cylinders 70 and 72.

The forward flanges 112 and 114 are positioned allowing a U-shaped cut-out 116 over the flanges 112 and 114.

The reciprocating cylinders 70 and 72 are secured to scotch yokes 118 and 120. In FIG. 1 it can be seen that one forward flange 122 of the reciprocating cylinder forward flange 112 is secured to scotch yoke 118 and the remaining forward flange 124 of the reciprocating cylinder forward flange 112 is secured to scotch yoke 120. Likewise, reciprocating cylinder 72 is also secured to both scotch yoke 118 and scotch yoke 120.

Housed within the reciprocating cylinders 70 and 72 are inner pistons 126 and 128. At the end of each of the inner pistons 126 and 128 are heads 130 and 132. The piston heads 130 and 132 have within them piston head cavities 134 and 136 the purpose of which is for oil cooling. At the extreme edge of the heads 130 and 132 are compression surfaces 138 and 140. Immediately behind the compression surfaces 138 and 140 are inner piston rings 142 and 144. Securing the piston heads 130 and 132 to the scotch yoke 146 are piston rods 148 and 150. In the preferred embodiment the piston rods 148 and 150 are conventionally secured to the scotch yoke 146 by bolts 152 and 154. As is evident, the reciprocating cylinders 70 and 72 are affixed to scotch yokes 118 and 120 only, while the inner pistons 126 and 128 are affixed to the scotch yoke 146 only.

The scotch yokes 118, 120 and 146 house scotch blocks, 156, 158, and 160. The scotch blocks 156, 158 and 160 slide vertically up and down corresponding to the horizontal movements of the reciprocating cylinders 70 and 72 and inner pistons 126 and 128.

Figure 7:
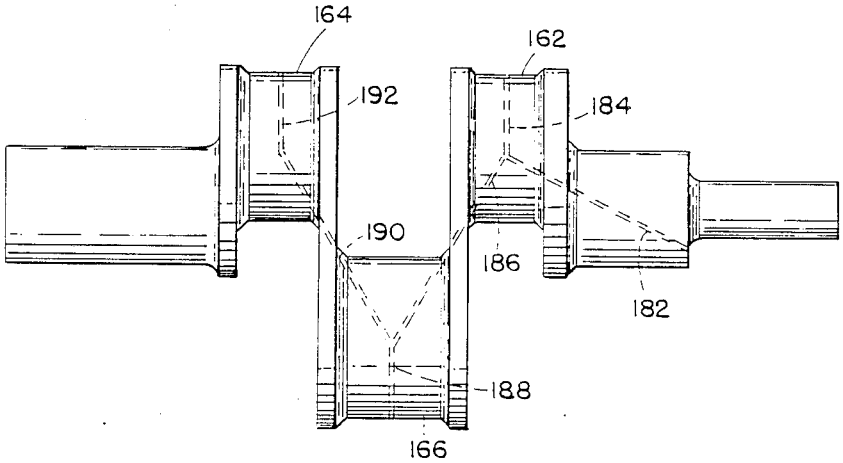
FIG. 7 is a perspective view of the crank shaft and three crankthrows.

The scotch blocks 156, 158 and 160 surround respective crank throws 162, 164 and 166 as illustrated in FIG. 7. The crank throws 162 and 164 are those surrounded by scotch blocks 156 and 158 housed within scotch yokes 118 and 120. The scotch yokes 118 and 120 are attached to reciprocating cylinders 70 and 72 and are, thus, powered by the horizontal back and forth movements of the reciprocating cylinders 70 and 72.

In the preferred embodiment, three crank throws are situated to power the crankshaft. For the most advantageous operation of the engine 10 it is desirable for the reciprocating cylinders 70 and 72 to move approximately one-half the horizontal distance of the inner pistons 126 and 128. To accomplish this, the reciprocating cylinder crank throws 162 and 164 are one-half of the diameter of the crank throw 166 of the inner pistons 126 and 128. Thus, in the preferred embodiment the crank throws 162 and 164 of the reciprocating cylinder are two inches in diameter whereas the crankthrow 166 of the inner piston is four inches in diameter. Additionally, it is desirable to have the reciprocating cylinder movement 190° to 200° later than the inner piston movement for desired port timing. To accomplish the 190° to 200° offset, the crank throws 162 and 164 are 180° apart. To introduce the additional 10° or more offset, the scotch yoke 118 is slanted the required number of degrees. Thus, in FIG. 2 it is shown that scotch yoke 118 is slanted approximately 10°. The same effect can be established by offset crankshaft throws.

The horizontal back and forth movement of the reciprocating cylinders 70 and 72 and inner pistons 126 and 128 accomplish motion by the scotch blocks 156, 158 and 160 which slide vertically. The scotch blocks 156, 158 and 160 are kept within the scotch yokes 118, 120 and 146 by scotch yoke guides 162 formed within the scotch blocks.

Affixed to the crankthrow 164 is cylindrical crankthrow extension 170. The cylindrical crankthrow extension 170 is secured to the flywheel 162. Affixed to the crankthrow 162 is cylindrical crankthrow extension 174, which is in turn affixed to the crankshaft 24. Crankthrow 166 is secured to crankthrows 162 and 164 by crankthrow walls 174 and 176. Thus, as crankthrow 166 rotates, it aids in the rotation of crankthrows 162 and 164 and vice versa. Thus, as the crankthrows 162, 164 and 166 rotate about the axis of the crankshaft 24, the crankshaft and in turn the flywheel are caused to rotate.

The engine 10 has an oil lubrication system. Surrounding the crankshaft 24 within the crankcase 18 is the oil supply chamber 178. Oil is supplied to the oil supply chamber 178 by the means of a vane oil pump 180. Cooling oil enters the crankthrow 162 through oil duct 182. Oil duct 182 extends into crankthrow 162 whereupon oil duct 182 intersects crankthrow extension oil duct 184 which supplies pressure fed oil to the surface of the crankthrow 162 lubricating the movement of the crankthrow 162.

Leading from oil duct 182 is oil duct 186 which supplies oil into within the crankthrow 166 whereupon oil duct 186 intersects crankthrow extension oil duct 188. Crankthrow extension oil duct 188 supplies pressure fed oil to the surface of the crankthrow 166 lubricating the movement of the crankthrow 166.

Leading from oil duct 186 is oil duct 190 which supplies oil into within the crankthrow 164 whereupon oil duct 190 intersects crankthrow extension oil duct 192. Crankthrow extension oil duct 192 supplies pressure fed oil to the surface of the crankthrow 164 lubricating the movement of the crankthrow 164.

Cooling oil movement is also facilitated through inner pistons 126 and 128. As illustrated in FIG. 2, oil duct 194 allows oil to move from the crankshaft into piston head cavity 136. Oil duct 196 allows oil to exit from the piston head cavity 136. Similarly, oil duct 198 allows oil to move from the crankshaft into the piston head cavity 134. Oil duct 200 allows oil to exit from the piston head cavity 134.

As illustrated in FIG. 2 ring oil lines 202 and 204 supply oil lubrication to the rings of the reciprocating cylinders. Ring oil exit lines 206 and 208 provide for the exit of oil from the rings of the reciprocating cylinders to the oil pan 210.

To better understand the invention, a complete cycle of the engine will be detailed step by step. We will begin with the reciprocating cylinders 70 and 72 in the inner pistons 126 and 128 in the position illustrated in FIG. 2. Further, we will begin in the position as illustrated in FIG. 2 by describing the reciprocating cylinder 72 and the inner piston 128. Reciprocating cylinder 72 and inner piston 128 are going through an exhaust cycle. In order to remember that during the compression cycle of reciprocating cylinder 72 and inner piston 128, the reciprocating cylinder 72 is moving towards the inner piston 128. However, after the compression cycle is completed, the inner piston 128 is moving towards reciprocating cylinder 70, and the reciprocating cylinder 72 is moving towards the inner chamber end wall 40. This is illustrated in FIG. 2 when the reciprocating cylinder 72 is sufficiently close to the air chamber end wall 40, the reciprocating cylinder intake port 102 becomes aligned with the air blower line 60 of the air pump 212. It is also important to note that the reciprocating cylinder exhaust port 82 came into alignment with the exhaust port 76 of the outer cylinder 30 prior to the alignment of the reciprocating intake port 102 with the air blower line 60. Thus, air above atmospheric pressure blows into the chamber 214 formed between the reciprocating cylinder 72 and the inner piston 128.

It is also evident, that when the reciprocating cylinder intake port 102 is in alignment with the blower line 60, that the inner piston 128 has moved sufficiently to expose the reciprocating cylinder exhaust port 82. In fact, the inner piston 128 cleared the reciprocating cylinder exhaust port 82 prior to the alignment of the reciprocating cylinder intake port 102 and air blower line 70. Thus, the high pressure air from the air pump which forms in the chamber 214 between the reciprocating cylinder 72 and the inner piston 128 pushes the exhaust out the reciprocating cylinder exhaust port 82 but subsequently out the exhaust port 76 of the outer cylinder 30. This then clears the exhaust out of the compression chamber 214 between the reciprocating cylinder 72 and the inner piston 128.

While the inner piston 128 and reciprocating cylinder 72 are in an exhaust cycle, the reciprocating cylinder 70 and inner piston 126 are in a compression cycle. As set forth in FIG. 2, the reciprocating cylinder 70 has moved away from the air chamber end wall 38 of the outer cylinder 30 thereby bringing the fuel injection nozzle 216 in alignment with the reciprocating cylinder intake port 100. The fuel injection pump 12 is properly timed such that when the reciprocating cylinder intake port 100 is aligned with the fuel injection nozzel 216, fuel will be fed into the combustion chamber 66 or formed by the compression wall 96 and the compression surface 138 of the inner piston 126. As the reciprocating cylinder 70 moves towards the inner piston 126 the reciprocating cylinder intake port 100 becomes less and less open. In addition, the compression chamber 66 becomes smaller and smaller until an explosion in the compression chamber 66 is reached. The fuel injection pump 12 is timed in order to inject fuel immediately preceeding the explosion in the compression chamber 66.

When reciprocating cylinder 70 is moving toward the inner piston 26, the reciprocating cylinder 70 is pushing scotch yokes 118 and 120 towards the opposite end of the outer cylinder 30. This in turn is causing the scotch blocks 156 and 160 to be raised with a vertical component.

Similarly, as the inner piston 126 is moving towards the reciprocating cylinder 72, the scotch yoke 146 is being pulled towards the reciprocating cylinder 72. Thus, the scotch yoke 146 is moving with a horizontal component towards the reciprocating cylinder 70. With the scotch yoke 146 moving with this horizontal component, the scotch block 158 is moving with a downward vertical component.

After the explosion in the compression chamber 66, the horizontal components of the reciprocating cylinder 70 and the inner piston 126 are reversed due to the force of the explosion. The new directions after the explosion are illustrated in FIG. 2 by directional arrow 222 and directional arrow 224.

After the explosion in the compression chamber 66, the reciprocating cylinder 70 reverses its direction and begins to pull on scotch yokes 118 and 120. The pulling on the scotch yokes 118 and 120 in turn pull on the reciprocating cylinder 72 and causes the reciprocating cylinder 72 to reverse its direction and move towards the inner piston 128. Also, after the explosion in the compression chamber 66, the inner piston 126 is caused to change direction and it begins to push on scotch yoke 146. The change in direction of the inner piston 126 in turn causes the inner piston 128 to reverse its direction and move towards the reciprocating cylinder 72. As the reciprocating cylinder 72 moves towards the inner piston 128, it eventually brings the reciprocating cylinder intake port in alignment with fuel injection nozzle 218. The fuel injection nozzle 218 is timed such that when the reciprocating cylinder intake port 102 comes into alignment with the fuel injection nozzle 218, fuel is introduced into the compression chamber. At this point in the cycle, the inner piston 128 has moved past the reciprocating cylinder exhaust port 82, closing the reciprocating cylinder exhaust port 82 and further the inner piston 128 is moving towards the compression wall 96 of the reciprocating cylinder 70 thereby narrowing the compression chamber 68.

During these movements, the reciprocating cylinder 70 is pushing scotch yokes 118 and 120 in a horizontal movement towards the reciprocating cylinder 70. This is causing the scotch blocks 156 and 160 to move in a downward component. In addition, the inner piston 128 is moving towards the reciprocating cylinder 70 and is, thus, pulling the scotch yoke 146 in a horizontal component towards reciprocating cylinder 72 thereby causing the scotch block 158 to have a vertical rising component. When the compression chamber 68 has sufficiently narrowed, an explosion occurs, and the directions of the reciprocating cylinder 72 and inner piston 128 reverse. Thus, the inner piston 128 begins a horizontal movement towards the reciprocating cylinder 70 and the reciprocating cylinder 72 moves towards the air chamber end wall 40 thus reversing the horizontal components pushing and pulling the scotch yokes 118, 120 and 146 in opposite directions.

In the preferred embodiment scotch yokes 118 and 120 are constructed at an approximate 10° angle from 90°. This has the added advantage of causing reciprocating cylinder intake ports 100 and 102 to stay open a few degrees longer which allows for a super charge of air.

It can be seen that once the explosion occurs in the compression chamber 68, the inner pistons 126 and 128 and reciprocating cylinders 70 and 72 assume the horizontal movement which was described initially in the first step. Thus, we have gone through a complete cycle. As is set forth in the explanation, there is no wasted movement. Thus, at every movement the reciprocating cylinders 70 and 72 and the inner pistons 126 and 128 are causing useful energy to be generated. This is true for the scotch yokes 118, 120 and 146 are moving also in a horizontal component which transfer useful energy to scotch blocks 156, 158 and 160 which in turn transfer this energy to the crankthrows 162, 164 and 166 which in turn cause the rotation of the crankshaft 24.

It is evident that due to the usefulness of the scotch blocks irregardless of which direction they are moving, that there is no energy wasted in an exhaust cycle. This is evident in conventional engines when exhaust is being cleared from a compression chamber after an explosion. In the present invention, the horizontal movement that is used in clearing the compression chamber during the cycle is also transferring useful energy to the pushed and pulled scotch yokes 118, 120 and 146.

Although a particular preferred embodiment of the invention has been disclosed above for illustrative purposes, it will be understood that variations or modifications thereof which lie within the scope of the appended claims are contemplated.

I claim:

1. An engine comprising:

a first reciprocating cylinder;

a second reciprocating cylinder;

a piston housed within the first reciprocating cylinder;

a second piston housed within the second reciprocating cylinder;

a means of housing the first and second reciprocating cylinders;

a compression wall within the first reciprocating cylinder;

a compression wall within the second reciprocating cylinder;

a means of interjecting fuel at proper timing between the compression walls and the pistons to cause combustion and reciprocating horizontal movement between the first and second reciprocating cylinders and the first and second pistons;

a crankshaft;

a means of withdrawing exhaust from the engine;

a crankthrow affixed to the crankshaft;

a second crankthrow affixed to the first crankthrow;

a third crankthrow affixed to the second crankthrow;

three scotch blocks, each scotch block surrounding one crankthrow;

three scotch yokes, with each of the scotch blocks housed within one of the scotch yokes;

a means of securing the first reciprocating cylinder to the first and third scotch yokes, said scotch yokes housing the first and third crankthrows;

a means of securing the second reciprocating cylinder to the first and third scotch yokes, said scotch yokes housing the first and third crankthrows;

a means for securing the first and second pistons to the second scotch yoke, said scotch yoke housing the second crankthrow; and the second crankthrow is 180° out of phase with the first and third crankthrows and is twice the diameter of the first and third crankthrows.

2. An engine comprising:

a housing having two spaced-apart, opposed cylinder receiving cavities and a crankcase therebetween, the longitudinal axes of the cylinder receiving cavities being substantially aligned;

a crankshaft extending through the crankcase transversely with respect to the cylinder receiving cavities;

two opposed, hollow, elongated reciprocating cylinders, each reciprocating cylinder having one end coupled to the crankshaft and the other end projecting outwardly therefrom, the projecting end of each reciprocating cylinder being housed within a respective cylinder receiving cavity for substantially compression-free longitudinal movement therein, the reciprocating cylinders being coupled to the crankshaft such that longitudinal motion of the reciprocating cylinders will produce rotation of the crankshaft;

two elongated pistons, each piston mounted within a respective reciprocating cylinder for longitudinal movement therein, each piston forming a compression chamber within the respective reciprocating cylinder when the piston is adjacent the projecting end of the reciprocating cylinder, the pistons coupled to the crankshaft such that longitudinal movement of the pistons will produce rotation of the crankshaft;

means for injecting fuel into the combustion chambers formed between the reciprocating cylinder and the piston;

means for coupling the pistons and reciprocating cylinders to the crankshaft such that each respective reciprocating cylinder and piston alternatively move toward each other for precombustion compression and away from each other upon combustion, the post-combustion separation of one reciprocating cylinder and piston pair simultaneously producing rotation of the crankshaft and compression of the other reciprocating cylinder and piston pair such that a continuous two-cycle action results;

means for scavenging the combusted air within the reciprocating cylinders;

the pistons and reciprocating cylinders being coupled to the crankshaft by means of a crankthrow assembly affixed to the crankshaft which comprises:

a piston crankthrow and a cylinder crankthrow, the crankthrows offset from one another with respect to the circumference of the crankshaft to provide the desired timing;

two scotch blocks, each scotch block surrounding a corresponding crankthrow;

a first and second scotch yoke, each scotch yoke housing a corresponding scotch block, the first scotch yoke secured to the pistons and the second scotch yoke secured to the reciprocating cylinders such that the longitudinal movement of the pistons and reciprocating cylinders will be transmitted through the crankthrow assembly to rotate the crankshaft; and the second scotch yoke is inclined with respect to the first scotch yoke to provide the desired timing.

3. An engine comprising:

a housing having two spaced-apart, opposed cylinder receiving cavities and a crankcase therebetween, the longitudinal axes of the cylinder receiving cavities being substantially aligned;

a crankshaft extending through the crankcase transversely with respect to the cylinder receiving cavities;

two hollow, elongated reciprocating cylinders, each reciprocating cylinder having one end coupled to the crankshaft and the other end projecting outwardly therefrom, the projecting end of each reciprocating cylinder being housed within a respective cylinder receiving cavity for longitudinal movement therein, the reciprocating cylinders being coupled to the crankshaft such that longitudinal motion of the reciprocating cylinders will produce rotation of the crankshaft;

two elongated pistons, each piston mounted within a respective reciprocating cylinder for longitudinal movement therein, each piston forming a compression chamber within the respective reciprocating cylinder when the piston is adjacent the projecting end of the reciprocating cylinder, the pistons coupled to the crankshaft such that longitudinal movement of the pistons will produce rotation of the crankshaft;

means for injecting fuel into the combustion chambers formed between the reciprocating cylinder and the piston;

means for coupling the pistons and reciprocating cylinders to the crankshaft such that each respective reciprocating cylinder and piston alternatively move toward each other for precombustion compression and away from each other upon combustion, the post-combustion separation of one reciprocating cylinder and piston pair simultaneously producing rotation of the crankshaft and compression of the other reciprocating cylinder and piston pair such that a continuous two-cycle action results;

means for scavenging the combusted air within the reciprocating cylinders; and a plurality of rings mounted in the reciprocating cylinder which surround the periphery of each reciprocating cylinder and means for providing pressurized oil to the rings during operation of the engine.

* * * * *